US005170647A

United States Patent [19]

Shima et al.

[11] Patent Number: 5,170,647

[45] Date of Patent: Dec. 15, 1992

[54] FLAT KNITTING MACHINE

[75] Inventors: Masahiro Shima; Shigeaki Nishibata, both of Wakayama, Japan

[73] Assignee: Shima Seiki Mfg. Ltd., Wakayama, Japan

[21] Appl. No.: 852,684

[22] Filed: Mar. 17, 1992

Related U.S. Application Data

[63] Continuation-in-part of Ser. No. 584,290, Sep. 18, 1990, abandoned.

[30] Foreign Application Priority Data

Oct. 4, 1989 [JP] Japan ..... 1-259564

[51] Int. Cl.[5] ..... D04B 7/00

[52] U.S. Cl. ..... 66/60 R; 254/323

[58] Field of Search ..... 66/60 R; 254/323

[56] References Cited

U.S. PATENT DOCUMENTS 4,240,274 12/1980 Schimko ..... 66/60 R X 4,423,852 1/1984 Conroy et al. ..... 254/323 X

*Primary Examiner*—Werner H. Schroeder
*Assistant Examiner*—John L. Calver
*Attorney, Agent, or Firm*—Barnes, Kisselle, Raisch, Choate, Whittemore & Hulbert

[57] ABSTRACT

A flexible cable support is provided in a flat knitting machine for supporting power supply cables. The flat knitting machine comprises a carriage that reciprocates along a needle bed. The flexible cable support and the power supply cables are connected at one end to a terminal unit on the needle bed at a position representing approximately the middle of the travel path of the carriage. The other end is connected to the reciprocating carriage. The flexible cable support is composed of a series of joint sections pivotally connected to each other forming a continuous flexible support so that, as the carriage reciprocates, the cables supported on the flexible support are allowed to freely bend and move with the carriage.

4 Claims, 4 Drawing Sheets

FLAT KNITTING MACHINE

This is a continuation-in-part of Ser. No. 07/584,290 filed Sep. 18, 1990 now abandoned.

FIELD OF INVENTION

The present invention relates to a flat knitting machine comprising cable support means for supporting a cable or cables for supplying power and electric signals to the carriage.

RELATED ART STATEMENT

A fixed cable connecting a controller for controlling a flat knitting machine to a terminal unit provided on the flat knitting machine to supply power and/or electric signals to the carriage is extended fixedly, while a movable cable connecting the carriage to the terminal unit is supported for free movement to allow the movable cable a free movement according to the reciprocating motion of the carriage. The movable cable is suspended on a cable suspending device in a zigzag direction. The cable expands or contracts according to the movement of the carriage. No problem arises in such cable support means as long as the carriage reciprocates at a comparatively low speed. However, it is possible that the movable cable is damaged due to its inertial movement in reversing the carriage when the carriage moves at a comparatively high speed or due to its vibrations caused by frequent application of load on the movable cable when the carriage reciprocates through a short stroke.

A weft knitting machine provided with two carriages on a single needle bed has problems attributable to the interference of movable cables connected to the carriages with the carriages.

OBJECT AND SUMMARY OF THE INVENTION

In view of the foregoing problems, it is an object of the present invention to provide cable support means capable of supporting movable cables for supplying power and electric signals to a plurality of carriages mounted on a single needle bed so that the movable cables may not interfere with each other and may not obstruct the individual movement of the carriages even when the carriages reciprocate rapidly. One type of cable support is disclosed in U.S. Pat. No. 3,779,003.

In a flat knitting machine comprising a needle bed, a frame supporting the needle bed, a carriage, and a guide member supporting and guiding the carriage for reciprocation along the needle bed, a terminal unit is provided on the frame at a position corresponding to the middle of the stroke of the carriage, one end of a cable for supplying power and electric signals to the carriage is connected to the terminals of the terminal unit, and the cable is supported by a flexible cable support structure.

In a flat knitting machine comprising a needle bed, a frame supporting the needle bed, two carriages, and a guide member supporting and guiding the two carriages for reciprocation along the needle bed, a terminal unit is provided on the frame, one end of each of two cables for supplying power and electric signals respectively to the two carriages is connected to the terminals of the terminal unit, the two cables are supported respectively by flexible cable support structures, and the flexible cable support structures are bent respectively on the opposite outer sides of the frame.

When the terminal unit is disposed at a position corresponding to the middle of the stroke of the carriage and one end of the cable connected to the carriage at the other end is connected to the terminal unit, the cable is required to move through the least distance and to have the least length.

Since the cables connected to the two carriages are supported respectively on the cable support structures bending respectively on the opposite outer sides of the frame of the flat knitting machine, the cables do not interfere with each other and are able to move independently.

DETAILED DESCRIPTION OF THE PREFERRED EMBODIMENT

A flat knitting machine in a preferred embodiment according to the present invention will be described hereinafter with reference to the accompanying drawings.

Figure 5:
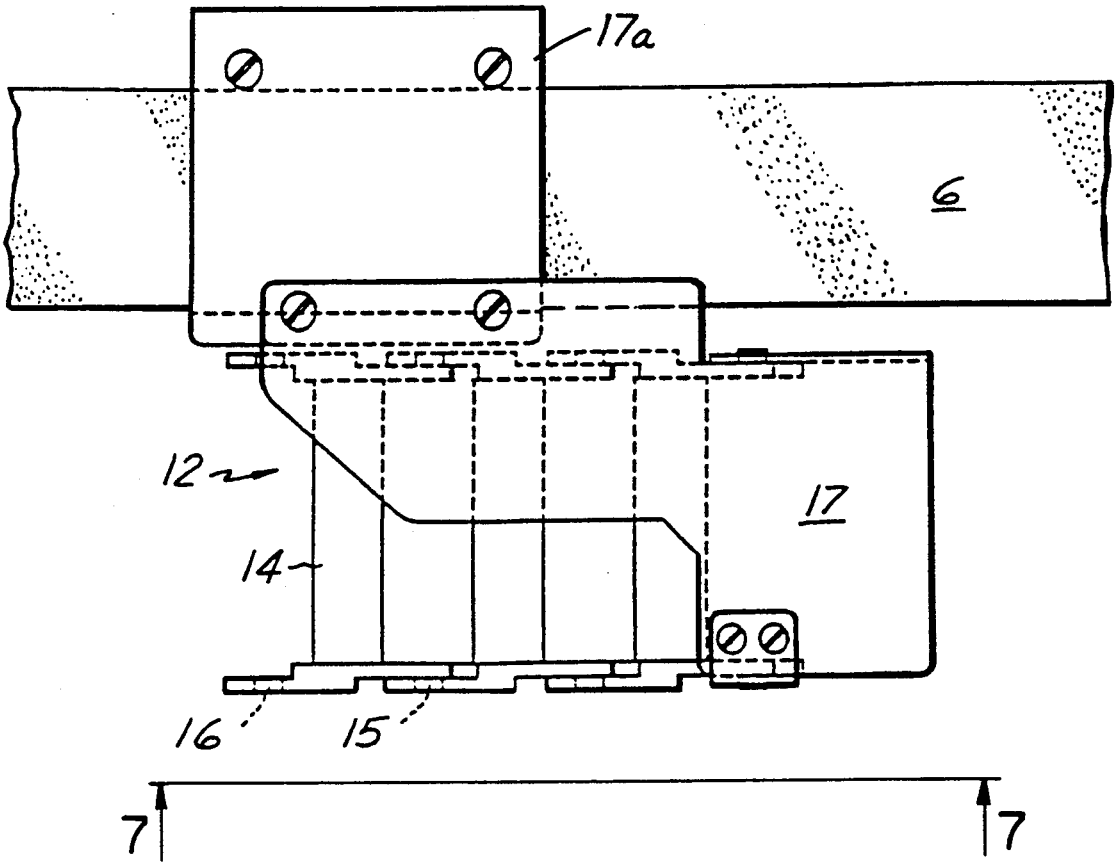
FIG. 5 is a plane view of a cable support structure.
Figure 6:
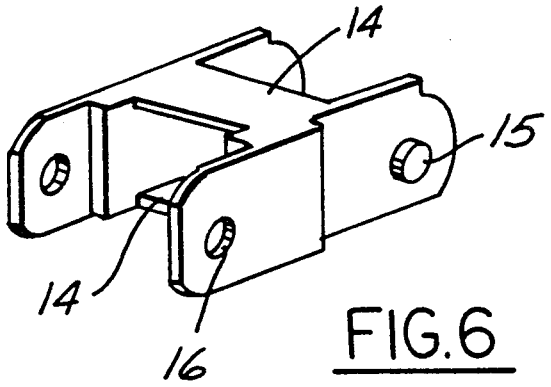
FIG. 6 is a perspective view of a joint member.
Figure 7:
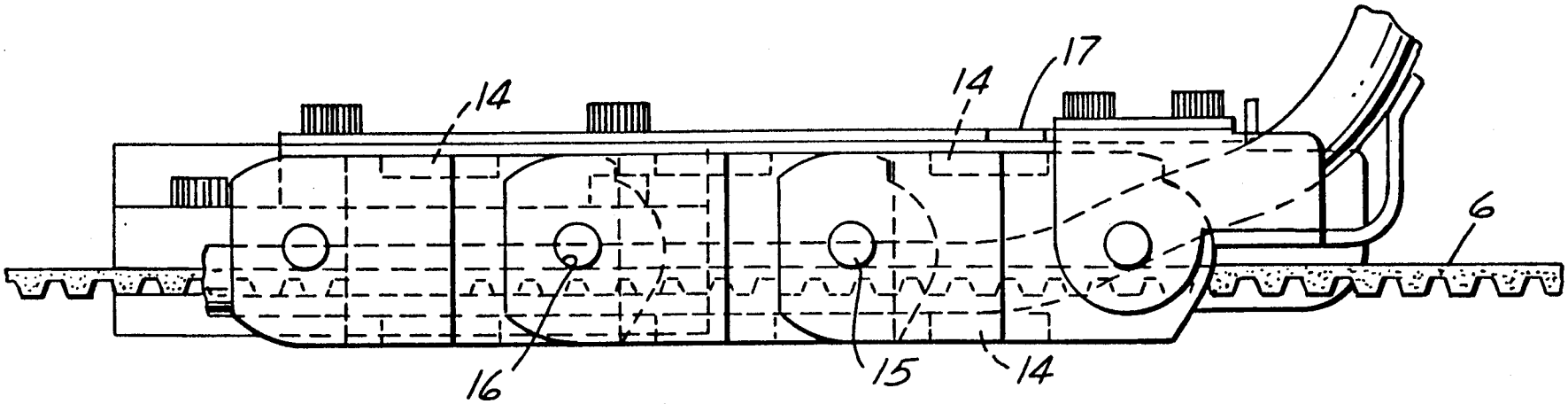
FIG. 7 is a view taken along line 7—7 in FIG. 5.
Figure 8:
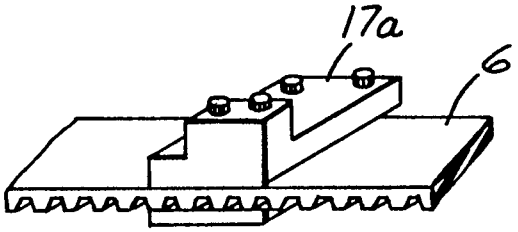
FIG. 8 is a perspective view of the belt held between upper and lower plates.

A flat knitting machine 1 has a needle bed 3 supported on a frame 2, and carriages 4 and 5 supported on a guide rail, now shown. The carriages 4 and 5 are drawn for reciprocation by a driving belt 6. The rotative force of a driving unit 7 is transmitted to the driving belt 6. Power and/or electric signals provided by a control unit 8 are transmitted through a fixed cable 9 connected to a terminal block 10 provided on the frame of the weft knitting machine 1. The carriages 4 and 5 are connected to the terminal block 10 respectively by cables 11*a* and 11*b*. The cables 11*a* and 11*b* are supported respectively on flexible cable support structures 12*a* and 12*b*. The flexible cable support structures 12*a* and 12*b* are supported on a support member 13. Referring to FIG. 5 showing the construction of the flexible cable support structures 12*a* and 12*b*, each of the flexible cable support structures 12*a* and 12*b* is formed by fitting projections 15 formed on the side walls of each joint section in a small bore 16 formed in side walls of the adjacent joint section to connect the adjacent joint sections. The plurality of small joints 14 of each joint section comprise an upper small joint 14 and a lower small joint 14 (FIG. 6) that, with the side walls, form an open housing within which the cables are supported. A terminal member 17 connected to one end of the series arrangement of the joint sections is fastened to the driving belt 6, so that the flexible cable support structure 12*a* (12*b*) is bent according to the turning motion of the driving belt 6, hence according to the reciprocation of the carriage 4. (5). The belt is held between upper and lower plates 17*a*, 17*b* (FIG. 8) and is secured by any means, such as bolts 17*c*, 17*d*. The terminal member 17 is connected to the upper plate 17*a* by bolts 17*d* (FIG. 7). The cables 11*a* and 11*b* are supported between upper and lower small joints 14.

Figure 9:
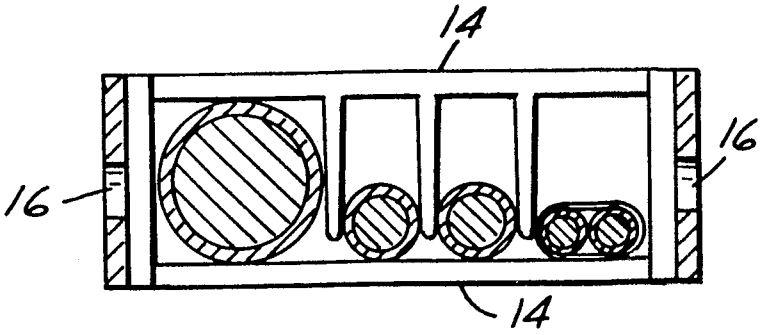
FIG. 9 is a cross section of another embodiment of the joint section.

Another embodiment of the joint section can be seen in FIG. 9 where guide plates 18*a*, 18*b*, 18*c* are provided on the upper small joint 14 to provide further support for cables of varying diameters.

The flexible cable support structures 12*a* and 12*b* connected respectively to the carriages 4 and 5 are capable of bending respectively on the opposite outer sides of the frame, and both the flexible cable support structures 12*a* and 12*b* are supported on the support member 13 for free bending.

Figure 1:
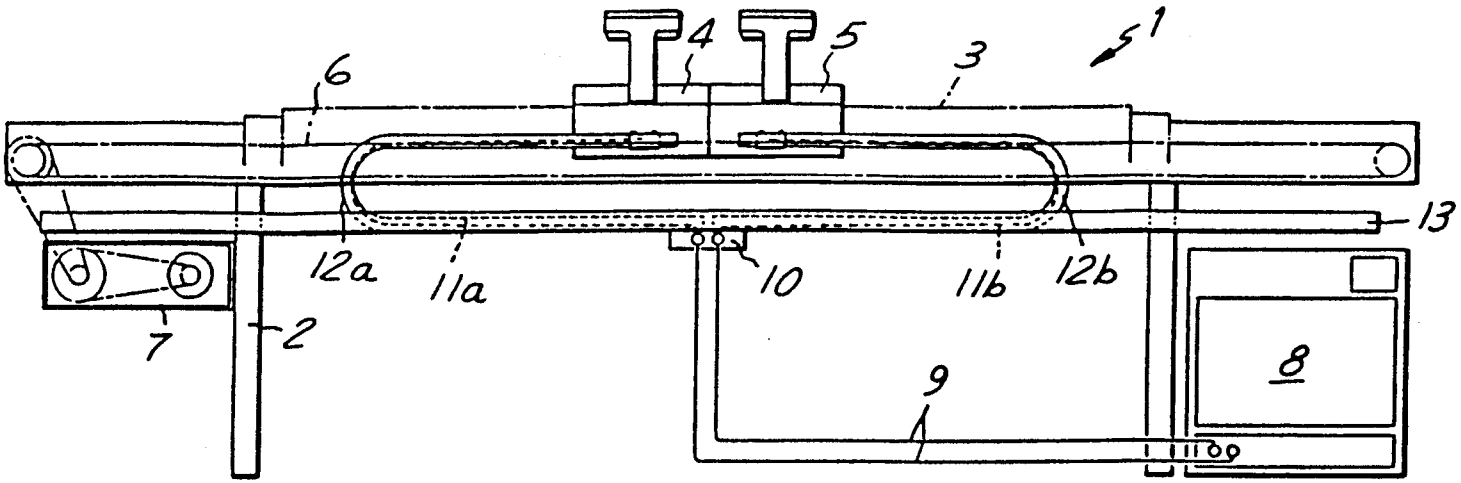
FIGS. 1–4 are front views of a flat knitting machine embodying the present invention, showing the carriages at different positions.
Figure 2:
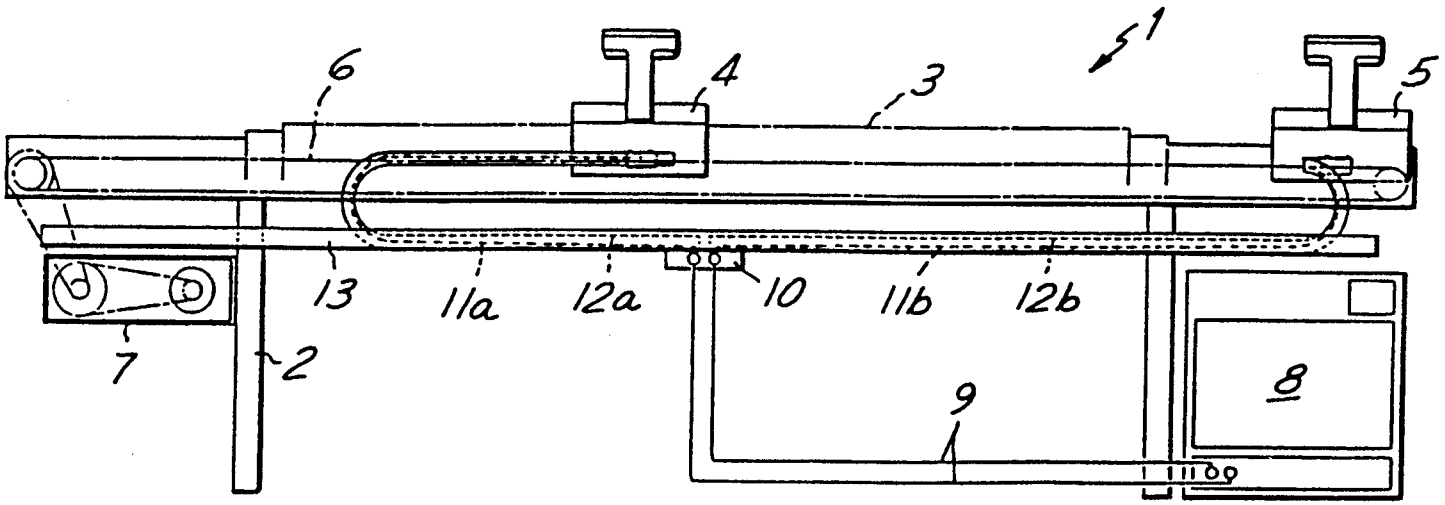
Figure 3:
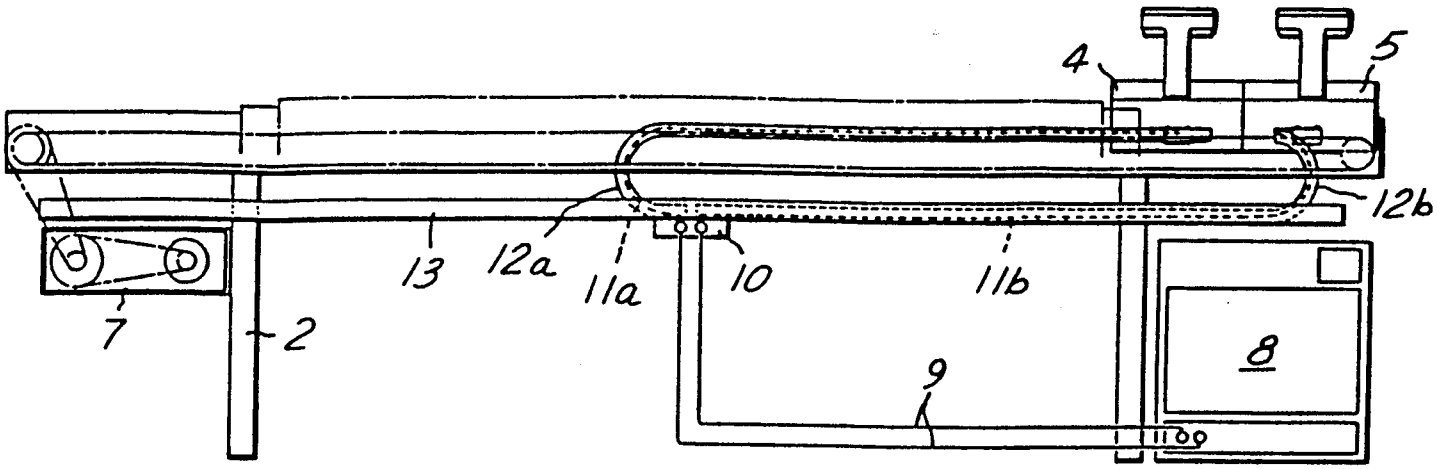
Figure 4:
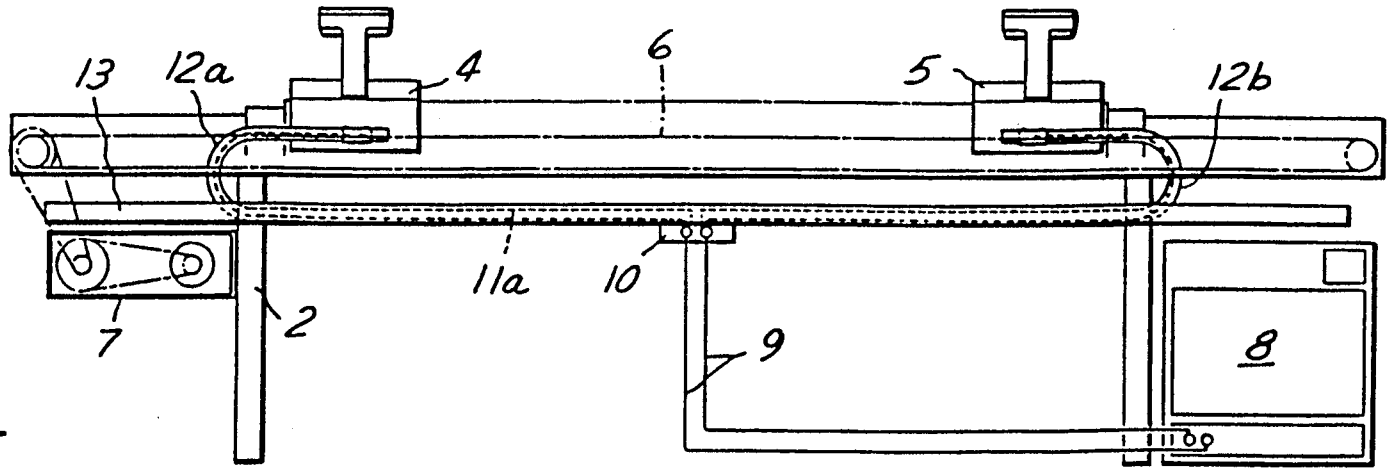

The carriages 4 and 5 of the flat knitting machine thus constructed are able to move individually as shown in FIGS. 2 to 4. In either mode of movement, the flexible cable support structures 12*a* and 12*b* supporting the cables 11*a* and 11*b* connected to the carriages 4 and 5, respectively, are able to move individually without interfering with each other.

As is apparent from the foregoing description, in the flat knitting machine according to the present invention, the cable for supplying power and/or electric signals to the carriage supported on and guided by the guide member for movement along the needle bed is provided at a position corresponding to the middle of the stroke of the carriage and the cable is supported by the flexible cable support structure. Accordingly, the length of the cable may be about half the stroke of the carriage even if the carriage reciprocates over the entire width of the needle bed and the bend in the cable moves within the narrowest range. When the flat knitting machine is provided with the two carriages, the cables connected to the carriages are capable of bending respectively on the opposite outer ends of the needle bed, so that the cables and the cable support structures are able to move individually without interfering with each other.

It is understood that the flexible cable support structure is but the preferred embodiment and that the invention is not limited to the single disclosed embodiment.

What is claimed is:

1. A flat knitting machine comprising a needle bed, a frame supporting the needle bed, a carriage, and a guide member supporting and guiding the carriage for reciprocation along the needle bed, and further comprising a terminal unit provided on the frame at a position corresponding to the middle of the stroke of the carriage, one end of a cable for supplying power and electric signals to the carriage connected to terminals of the terminal block, and wherein the cable is supported by a flexible cable support structure.

2. A flat knitting machine comprising a needle bed, a frame supporting the needle bed, two carriages, and a guide member supporting and guiding the two carriages for reciprocation along the needle bed, and further comprising a terminal unit provided on the frame, one end of each of two cables for supplying power and electric signals respectively to the two carriages connected to terminals of the terminal block, the two cables supported respectively by flexible cable support structures, and wherein the flexible cable support structures are capable of bending respectively on the opposite outer sides of the frame.

3. A flat knitting machine as claimed in claim 1 or 2, wherein said flexible cable support structure comprises a series of joint sections each having a plurality of small joints, said joint sections being formed with projections and small bores so that the joint sections are connected to each other by fitting the projections of one joint section into the small bores formed in the adjacent joint section.

4. A flat knitting machine as claimed in claim 3, wherein a support member for supporting the flexible support structures is provided to be extending under the needle bed.

* * * * *